US006793219B2

(12) United States Patent
Higginson

(10) Patent No.: US 6,793,219 B2
(45) Date of Patent: Sep. 21, 2004

(54) ACCUMULATION VARIATION OF LOTTERY-STYLE GAMES OF CHANCE

(75) Inventor: Henry C. Higginson, Wimberley, TX (US)

(73) Assignee: Trace Publishing Company, Wimberley, TX (US)

( * ) Notice: Subject to any disclaimer, the term of this patent is extended or adjusted under 35 U.S.C. 154(b) by 136 days.

(21) Appl. No.: 10/280,981

(22) Filed: Oct. 25, 2002

(65) Prior Publication Data

US 2003/0080507 A1 May 1, 2003

Related U.S. Application Data

(60) Provisional application No. 60/360,558, filed on Feb. 26, 2002, and provisional application No. 60/343,293, filed on Oct. 26, 2001.

(51) Int. Cl.[7] ..... A63F 3/00
(52) U.S. Cl. ..... 273/269; 463/18
(58) Field of Search ..... 273/269, 270, 273/274, 292, 139; 283/901, 903; 463/16, 17, 18, 19

(56) References Cited

U.S. PATENT DOCUMENTS

| | | | | | |
|---|---|---|---|---|---|
| 5,158,293 | A | | 10/1992 | Mullins | |
| 5,273,281 | A | | 12/1993 | Lovell | |
| 5,393,057 | A | * | 2/1995 | Marnell, II | 463/13 |
| 5,407,200 | A | | 4/1995 | Zalabak | |
| 5,647,798 | A | * | 7/1997 | Falciglia | 463/19 |
| 5,651,735 | A | * | 7/1997 | Baba | 463/18 |
| 5,743,524 | A | | 4/1998 | Nannicola | |
| 5,772,511 | A | | 6/1998 | Smeltzer | |
| 5,979,894 | A | * | 11/1999 | Alexoff | 273/139 |
| 6,086,477 | A | * | 7/2000 | Walker et al. | 463/17 |
| 6,099,407 | A | * | 8/2000 | Parker et al. | 463/19 |
| 6,102,400 | A | * | 8/2000 | Scott et al. | 273/269 |
| 6,325,716 | B1 | | 12/2001 | Walker et al. | |
| 6,386,975 | B1 | | 5/2002 | Peterson | |
| 6,416,408 | B2 | | 7/2002 | Tracy et al. | |
| 6,497,408 | B1 | | 12/2002 | Walker et al. | |
| 6,599,186 | B1 | * | 7/2003 | Walker et al. | 463/17 |
| 6,709,331 | B2 | * | 3/2004 | Berman | 463/16 |
| 2001/0034262 | A1 | | 10/2001 | Banyai | |
| 2003/0045338 | A1 | | 3/2003 | Dolloff et al. | |
| 2004/0032084 | A1 | * | 2/2004 | Higginson | 273/269 |

* cited by examiner

*Primary Examiner*—William M. Pierce
(74) *Attorney, Agent, or Firm*—Locke Liddell & Sapp LLP; Monty L. Ross; Mark R. Backofen

(57) ABSTRACT

A variation of a lottery-type game of chance where each drawing is not only a stand-alone event, but each entry is also valid for a defined number of accumulation rounds. The numbers selected for the entry are then compared to a predefined number of consecutive drawings. The total number of matches (or "hits") during all of these accumulation rounds is used to determine if the entry is a winner. This variation can be conducted alongside the standard lottery-type game without interference and entries can begin and end their accumulation period at different times during the duration of the game.

22 Claims, 5 Drawing Sheets

ACCUMULATION VARIATION OF LOTTERY-STYLE GAMES OF CHANCE

CROSS REFERENCE TO RELATED APPLICATIONS

This Nonprovisional application is based upon and claims priority to the inventor's Provisional Patent Application No. 60/343,293 entitled "Triple Win Accumulation Keno," filed Oct. 26, 2001 as well as Provisional Patent Application No. 60/360,558 entitled "Unique and Original Variation in Format for Lottery-Style Games of Chance," filed on Feb. 26, 2002.

BACKGROUND OF THE INVENTION

1. Field of the Invention

This invention relates generally to games of chance predicated on the selection of numbers and, more particularly, to an accumulation variant of lottery-style games of chance.

2. Description of Related Art

All games of chance based upon the selection of numbers, such as Keno and state run lotteries, operate on the same basic procedures. Players pick a set of numbers, submit a play slip with the required fee, and receive an official ticket to confirm their entries. The set of numbers is good for only the single game or drawing that is identified on the ticket. At a designated later time, a group of numbers are randomly drawn and become the official winning numbers. Depending on whether the player's numbers match at least a predetermined amount of the winning numbers, he or she may be a winner. A variation on this is that a player can pre-pay to play the same set of numbers for multiple consecutive games or drawings. The entry is then valid for the selected number of consecutive individual games or drawings. It is as if the player purchased a number of separate entries and selecting the same set of numbers on each entry. There are several significant variations based upon this common platform.

In one variation, commonly called Keno, there are a number of different playing options available, thereby providing the player a choice of the amount of the wager for each ticket. Players can choose from a wide range of games, involving the selection of from only one or two numbers to often as many as twenty, all from the same pool of eighty numbers in play during each drawing. The prize threshold amount depend entirely upon the Keno game chosen and are determined ahead of time by the casino and are based upon the payout policies and the probability of winning. Each Keno location is independent and has its own fixed payment tables to determine prize amounts based upon the Keno game and number of correct matches.

The wide variety of games available in Keno, results in an increased amount of information that must be manually entered into the system computer before an official ticket can be printed and the entry activated. Consequently, there is a larger staff requirement and increased interaction between the players and staff, who are often referred to as "Keno Writers". The high staffing requirements mean that a large jackpot win can, and often does, drain most or all of the profits from the Keno game for a considerable period. Since the number of tickets that one Keno Writer can issue, even with the aid of computerization, is constant, attempts to increase the number of tickets sold will not necessarily increase the casino's revenue or profits from the game.

Another variation of number based games of chance is a lottery, such as the ones operated by various states. Players generally have only a single play mode with a fixed price for each entry, generally one dollar. This lack of choice allows many remote locations to be linked together in a single lottery game without the need for a large dedicated staff to run the game. The prize payouts are generally pari-mutuel except for the lower payouts, which are fixed in much the same way as in Keno. This means that the major prize levels are calculated based on a percentage of the total amount wagered by all participants in each drawing. If there is no winner, the proceeds are often carried over to the subsequent drawing, thereby increasing the "pot" of funds available for the top prize levels of the subsequent drawing. As a result, the sale of lottery tickets fluctuate based upon the estimated jackpot size.

In some cases the distinction between the lottery and Keno variations is being blurred. State run lotteries have recently been introducing new promotions and games to increase revenues and lure more players. Games such as "Texas Millions" completely dispense with the pari-mutuel system of variable jackpots and set fixed amounts for all prize levels, irrespective of the total amount wagered by all participants. Texas Millions involves multiple sets of numbers issued for a single entry and the prize amount varies depending on which set contained the winning numbers. Other games have added features that allow players to pick "bonus numbers" thereby making the game more like the variable number situation of Keno. However, even these hybrid games still follow the same basic premise of all prior games of chance based upon the selection of numbers.

This basic premise is that each drawing is a stand-alone event. After the official numbers are drawn, the entries for that particular draw go "dead." A player may have pre-paid for use of the same numbers in multiple consecutive draws, in which event the same numbers will stay alive for a series of identical, one-time events. However, this is the same as purchasing a number of entries and selecting the same set of numbers for each one. In any event, none of the prior games of chance based upon the selection of numbers involves the accumulation of matches over a number of games or drawings.

SUMMARY OF THE INVENTION

A new variant of a game of chance based upon the selection of numbers, where each entry would, in addition to the traditional single drawing, be valid in an accumulation mode for multiple additional drawings. A player purchases an entry in the normal manner and pays an additional fee to add the accumulation option to his or her entry. The entry is valid for the single or multiple game or drawing as a traditional entry would be and in the same manner. In addition, the entry is also valid for an additional defined number of games or drawings, which may include the original drawing, in an accumulation mode. Preferably, each entry is independent of all other entries and can start on any ordinary drawing during the course of the game without affecting the length of the accumulation period. During these additional drawings, the number of matches between the entry and the official winning numbers for each drawing are added together to obtain a total number of matches. If the entry can be a variable length of numbers, such as in Keno, the accumulation total is the ratio between the total number of matches and the number of numbers selected in the entry. If the entry is of a defined length of numbers, such as a standard lottery game, the number of matches is the accumulation total. If the accumulation total is above a set threshold at the end of the additional drawings, the player is a winner. Preferably, there would be a second and third prize level for the entries with the highest accumulation total during set periods, such as the month for the second level and the year for the third level.

BRIEF DESCRIPTION OF THE DRAWINGS

The invention is further described and explained in relation to the following figures of the drawings, wherein.

DETAILED DESCRIPTION OF THE PREFERRED EMBODIMENT

The following description will describe the embodiments of the current invention that are preferred under the stated circumstances. Mathematically, there are an enormous number of permutations of the current invention that could be implemented. Currently, there is no one embodiment that is viewed by the inventor as being superior in all situations. The specific game parameters depend upon at least the following, the number of play variations available to the player (as in Keno) if more than one (as in most lotteries), the size of the expected player pool, the percentage of revenues that will be paid out as prizes, the desired overall length of the competition cycle, and the pool of numbers available. The payout table and other characteristics of the game can be determined in a manner known to those of skill in the art based upon these particular circumstances.

Figure 1A:
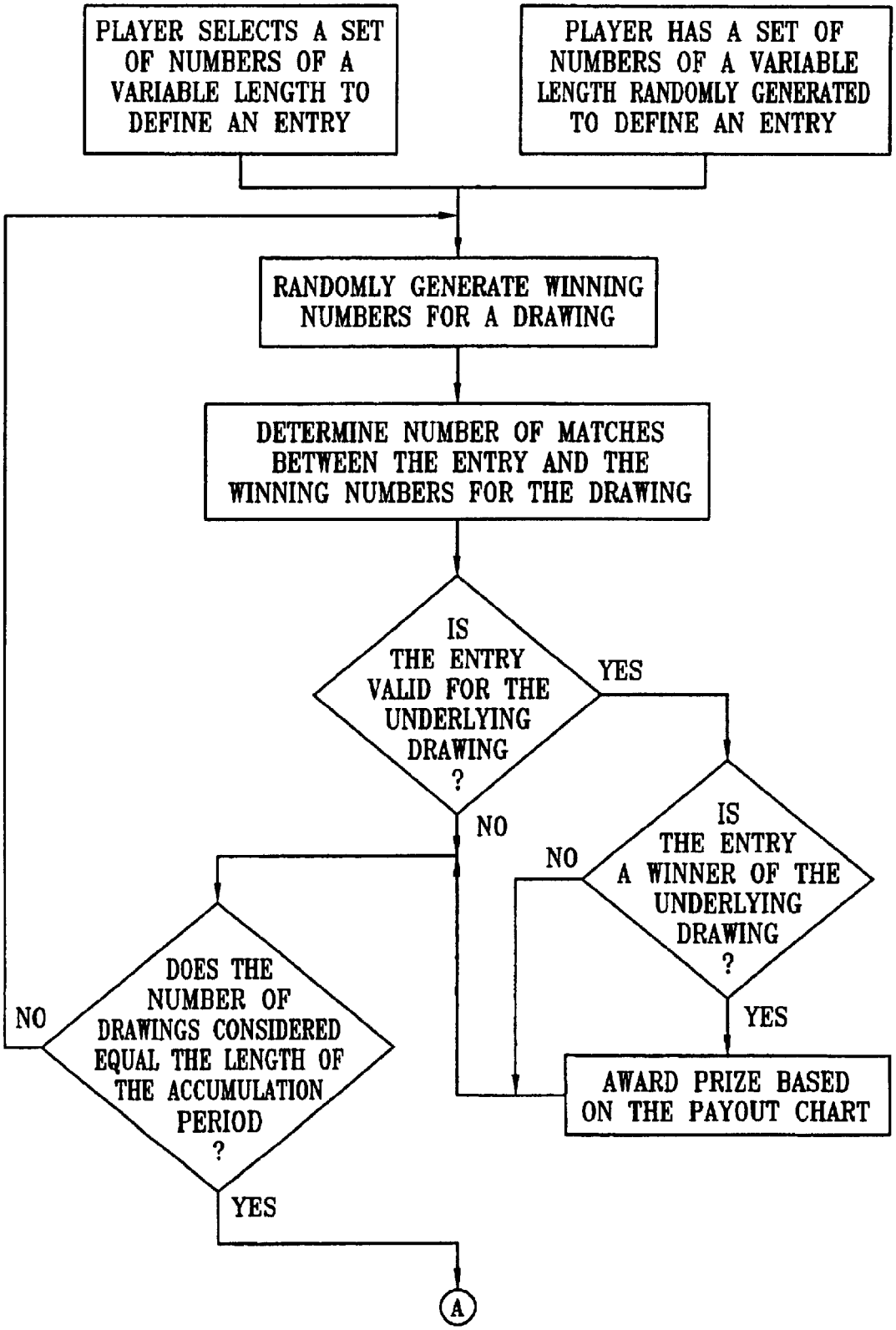
FIGS. 1*a* and 1*b* is a flow chart depicting a first embodiment of the current invention where the invention is applied in the context of a Keno game.
Figure 1B:
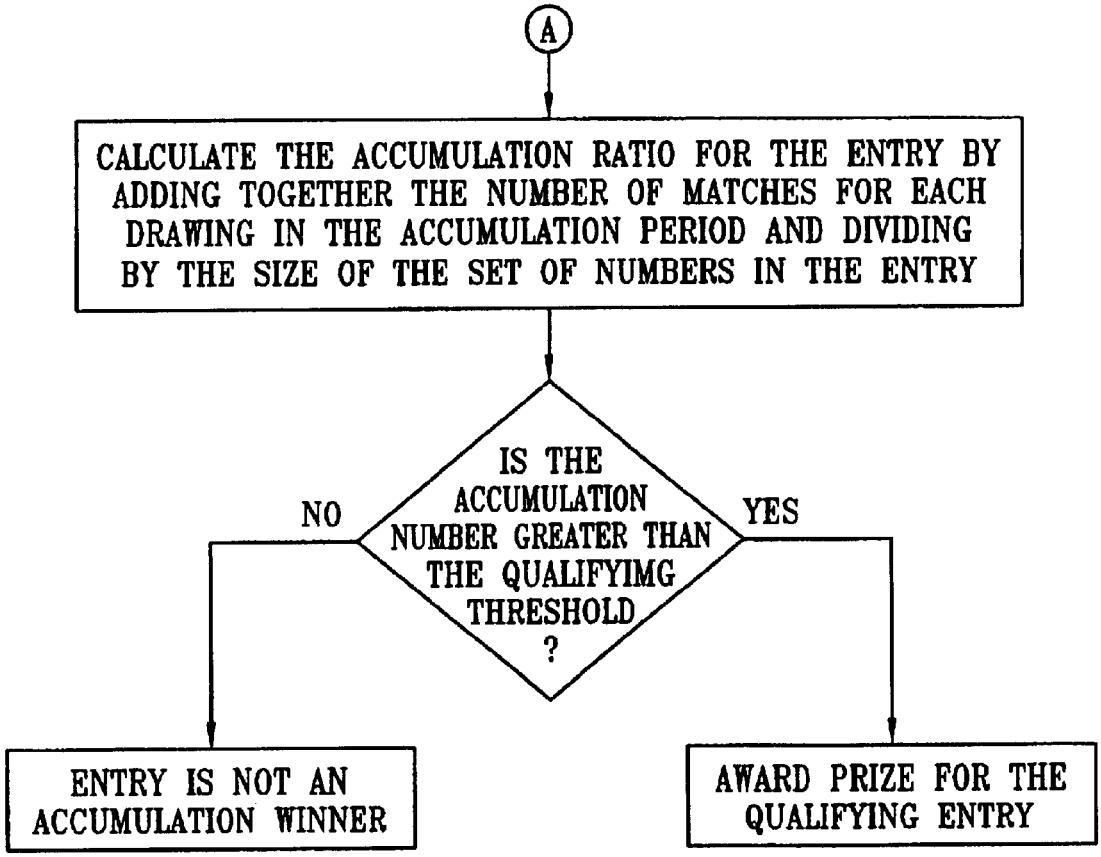

As shown in FIGS. 1*a* and 1*b*, a first embodiment is for use in a typical casino Keno lounge and is referred to as "Accumulation Keno". For an additional fixed fee players can add the Accumulation Keno option to any or all of their regular Keno tickets. It does not matter how much the original wager was for or how many numbers were picked for the entry. If the ticket is a winner during the traditional drawing, the Keno Writer will make a copy of the winning ticket as is common in Keno establishments, issue the winnings to the player, and return the ticket or the official facsimile to the player for the accumulation rounds. The single traditional drawing for which the ticket was purchased may also be the first game in the accumulation mode. For the next defined number of drawings, all matches from each drawing are added together to obtain a total. The accumulation total is calculated as the ratio between the total number of matches (or "hits") to the size of the original set of numbers selected by the player. That accumulation total is compared to a payout chart to determine if it is a winner and therefore a Qualifier for the second and third rounds.

The payout chart would be based upon the ratio of the number of matches made during the accumulation rounds to the number of numbers that were selected on the entry ticket. This can be accomplished through a payout table that has the number of matches along the top and the size of the player's original set along the side. Where the column meets the row, is the amount of the prize won for that particular ratio. For example, if there were a total of 60 matches and the player originally selected 20 numbers, the accumulation total would be 60:20. By looking at the column labeled 60 and following it down until it intersected with the row labeled 20, the player would see the amount of the prize that was won, if any. In this way, the amount of the prize can be higher for higher accumulation ratios, due to the lower probability of a player reaching those higher ratios. Preferably, at least 15% of the total prize money available would be distributed to first level winners, or qualifiers, during the course of the entire game cycle.

For example, if six numbers were selected on the entry and the accumulation round was six drawings long, the maximum possible number of matches, sometime called a "Grand Slam", would be 36. In this case, the threshold for qualifying could be anywhere from as low as twelve (12) to as high as eighteen (18), depending upon the payout rate and the prize level desired by the casino. The lower the threshold to qualify, the more entries would be sold along with a higher payout rate. Therefore, the qualifying threshold and the payout amount can be altered by the casino operator to achieve the largest draw of players while maintaining a desired payout ratio.

Figure 3:
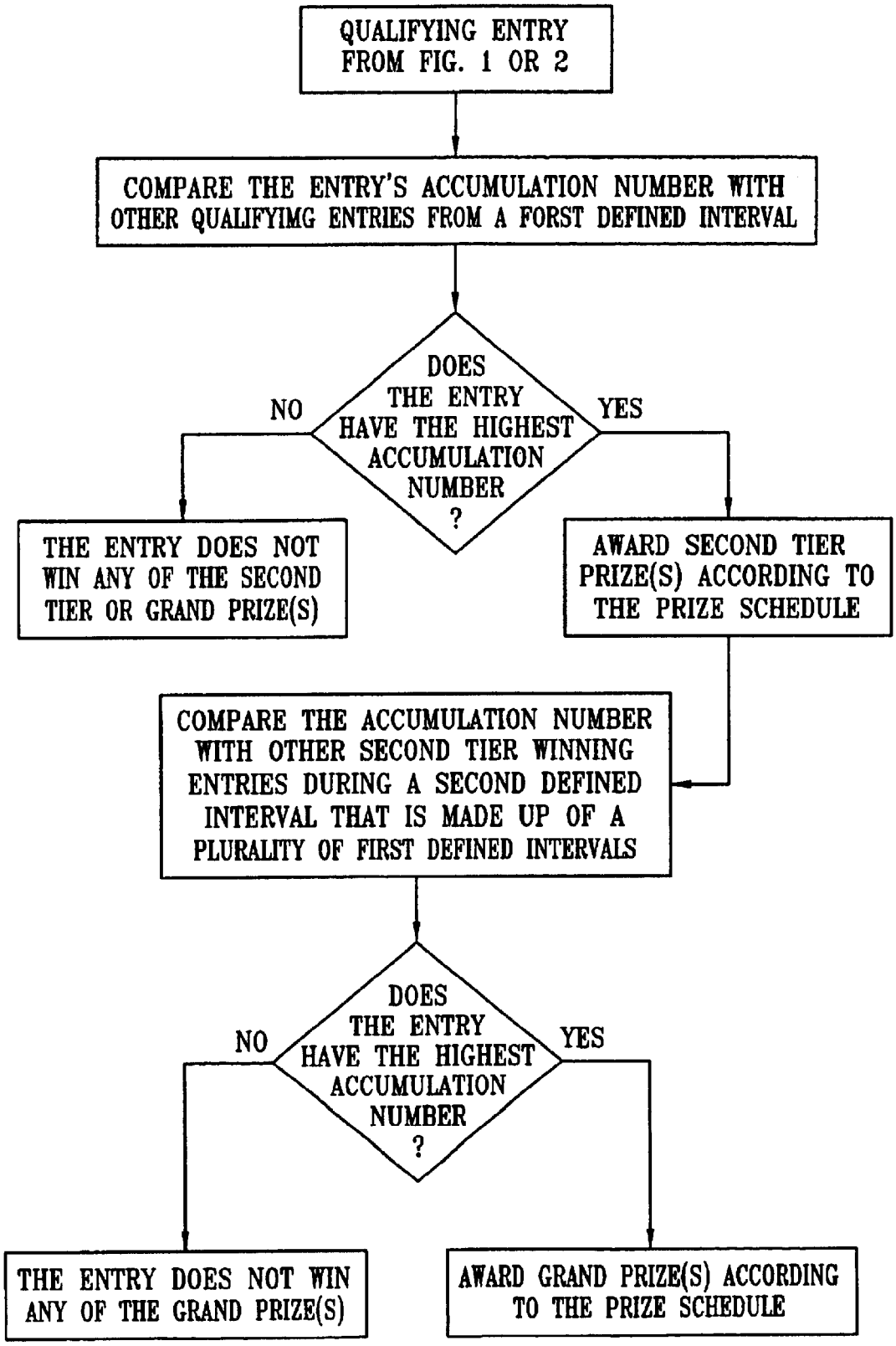
FIG. 3 is a flow chart depicting another embodiment of the current invention where the qualifying entries during set periods compete for additional prizes.

In addition, as shown in FIG. 3, all Qualifiers would be automatically eligible for the Second Tier Prizes. This could be for, say, five Qualifiers with the highest accumulation ratio on a single entry during each calendar month. This prize is a guaranteed distribution each month to the entries with the highest accumulation ratios regardless of the overall level of accumulation ratios that month. The advantage of allowing only the Qualifiers to be considered for the second round prize is that only Qualifier tickets need to be kept in the computer system storage after the end of the accumulation period for each entry. As long as there are at least five Qualifiers each month, there would be no way any non-qualifier would be able to win any of the monthly prizes. The prize payout for this Second Tier Prize could range from one thousand ($1,000) to five thousand dollars ($5,000), for the winner, with lesser amounts for the runners-up.

All monthly prize winners would then become further eligible for a group of Third Tier prizes, including a Grand Prize, at the end of the game, which may be a calendar year. The Grand Prize may be in the form of a progressive jackpot with an attractive minimum starting point or a preset amount ranging for example from fifty thousand ($50,000) to five million dollars ($5,000,000). Only the winners of the monthly prizes would be considered for the grand prize, so only monthly winning tickets need necessarily be stored after the respective monthly drawing.

The payout schedule is generally based upon mathematical modeling of probabilities to conform to the payout policies of the casino, in the same way the standard payout table is generated for traditional Keno games. Simple standard mathematical calculations can be used to determine the probability of winning based upon the number of number selected, the size of the Keno pool (i.e. the numbers that can be chosen, typically 1–80), the number of winning numbers selected each round (typically 20) and the number of accumulation rounds. For example, in an 80 number pool, and with 20 numbers selected each round as winners, there is a 25% chance that any one particular number will be picked in that round. However, there is only a 6.25% chance that two chosen numbers will both be picked in the same round. The chance of having those two numbers picked in either of two rounds is back to 25%.

In this way the number of accumulation rounds, payout thresholds, and payout amounts are chosen so that over the long run the likely total payout would be the desired percentage of the revenues taken in from the game according to the casino's payment policies. The sum of the prize amount times the probability of that outcome for each possible outcome is calculated. This yields the average payout per player. The game parameters and prize amounts can be adjusted until the total expected payout is the desired percentage of the cost of adding the accumulation option. The ranges of the second and third prize levels can be calculated in a similar manner as a percentage of total expected revenue.

Thus a particular Accumulation Keno game might look like the following. It is assumed for present purposes that the desired First Tier payout rate for all qualifiers is 25% of revenue. A traditional Keno game involving a pool of 80 numbers with 20 numbers selected each game is used and the accumulation period is 10 drawings. In a casino that sells 3,000,000 regular Keno tickets each year, on the basis of just one in three players adding the accumulation mode to the regular ticket play, one million (1,000,000) accumulation tickets would be sold during the calendar year duration of the game. With the accumulation game costing an additional $1 per entry, there is an estimated one million dollars ($1,000,000) in revenue for the entire game. For a ticket where eight (8) numbers were selected ("8 spot"), the qualifying threshold may be set at 31 matches or hits; for a ten (10) spot ticket, that threshold may be 39. With an expectation that approximately 415 tickets in all will be winners each month, depending on casino payout policy, the qualifying prize for the First Tier Level, irrespective of the regular game played, may be set at fifty dollars ($50), to return 25% of the total pool back to Qualifiers as First Tier prizes.

The amount of this First Tier prize does not vary with the number of hits on the ticket, but the greater the number of hits, the greater the chance that a qualifying ticket will win one of the Second Tier prizes and qualify for the opportunity to win one of the major Third Tier prizes that are payable at the end of the game.

If the payout for all of the monthly Second Tier prizes during the game is set at 12% of the revenue from the same wager pool, there would be ten thousand dollars ($10,000) available each month for distribution to the selected number of monthly Second Tier prize winners, selected from ALL Qualifiers that month on the basis of the highest ratio of matches achieved during their respective accumulation periods. In this example, the win amounts would be preset at five thousand dollars ($5,000) for the Qualifier(s) with the highest ratio of hits, two thousand dollars ($2,000) for second place, and three prizes of one thousand dollars ($1,000) for Qualifiers with the next three highest ratios. Since it is theoretically possible that more than one ticket could achieve the same hit ratio, then in such an event, the prize would be shared among those tickets achieving that ratio.

The minimum Grand Prize, and any lesser Third Tier Prizes that are payable at the end of the year long game, are set at an additional 10% of the revenue. The Third Tier Prizes could be set at a minimum guarantee of fifty thousand dollars ($50,000) for the Grand Prize, irrespective of the ratio of hits achieved, and an additional fifty thousand dollars ($50,000) to be distributed among the other end-of-game Third Tier winners. However, should the casino offer a bonus payout to the Grand Prize Winner, depending upon the accumulation ratio of the winning ticket, the total payout to the Grand Prize Winner in our Accumulation Keno model could escalate from the $50,000 minimum guarantee to as much as one million dollars ($1,000,000) or more. Alternatively, an offering casino may prefer to set a guaranteed minimum Grand Prize but have a progressive jackpot that is payable irrespective of the ratio of winning hits achieved on the winning ticket.

Since the bonus payout, at whatever level, if not covered, could adversely impact the profitability of the game for the casino, it is assumed that the operator would take out insurance to cover the risk of a payout in excess of the minimum Grand Prize guaranteed by the casino. Thus, in our example, the residual gross profit for the casino from the operation of a one year long game would be $430,000 or 43% of the wager pool, less the cost of risk premiums for insurance to cover any bonus payouts to the Grand Prize Winner.

From a player's perspective, the modest additional price of a single dollar added to any regular ticket regardless of the amount of the original wager, extends the life of the ticket and brings three additional and separate winning chances, including two if not all three, chances of winning prizes substantially in excess of what is available, in most cases, from a standard ticket. For example, in most casinos a player with a regular five spot ticket, if all five numbers come up in that single drawing, may win just $500 to $700 for a one-dollar wager. Three matches or hits in that single game at the most may only recover the amount of the wager. For only a single dollar more, that same ticket in accumulation mode could bring him, $50, $5,000, perhaps as much as $1,000,000 or more, and maybe all three.

The simplicity of the system is also an attraction. Players just add up their matches and consult the payoff chart to determine if their ticket is a winner. If the ticket is a winner, the player collects the First Tier prize at the end of the ticket's accumulation period and then can sit back and watch the entry compete with the other Qualifiers for the larger Second and Third Tier Prizes. The impulse to continue adding the extra $1 to all his subsequent regular play tickets is further enhanced by the knowledge that, unlike most casino games, not only the Qualifying First Tier prizes are guaranteed, but the monthly Second Tier and end-of-game minimum, bonus or progressive jackpot Third Tier Grand Prizes are guaranteed and will be paid out to somebody in accordance with the schedule. There is no requirement to hit any preset and virtually impossible target once a ticket has qualified for the subsequent prize tiers.

The advantage of the system from the casino's perspective is that it provides an additional revenue source as opposed to merely shifting income from one game to another. Players will continue to play their usual Keno games but are now able to increase their winning chances by adding the accumulation option to their ticket. This results in a higher average wager made per ticket, increasing revenue without the increased staffing requirement involved with having to issue additional tickets. Revenue is thereby generated without a corresponding increase in costs associated with the sale of additional tickets in traditional Keno games.

Additional hardware, if any, would be minimal and only what may be required to add the accumulation variant to a traditional Keno operation. The simple operating and tracking system that is necessary to add the accumulation option to traditional Keno lounges likely can be fully implemented by the existing standard hardware. A simple program can overlay the current Keno system and be able to extract the relevant information necessary to administer the game. At most a single separate computer may be necessary for record retention and control over any desired additional visual and audio recordings and prompts used to attract and retain players.

The accumulation variant would only require the addition of a few procedures to normal Keno operations. Keno tickets already typically have a start and end game number. A cipher would be added to the entry to designate it an accumulation ticket as well as the number of the last game in the accumulation sequence. This allows different tickets to start and end their accumulation periods at different times. A winning ticket in the traditional drawing(s) is copied by the Keno Writer, the winnings paid to the player, and the ticket is returned until the accumulation sequence is finished. That copy procedure is already a common part of standard Keno operations in casinos where many players wish to retain copies of their tickets for later reference. Copies of tickets would also be issued when collecting the Second Tier prizes. Therefore, there would be little additional training of Keno Writers or development of procedures to implement the accumulation variant to a standard Keno operation.

Figure 2A:
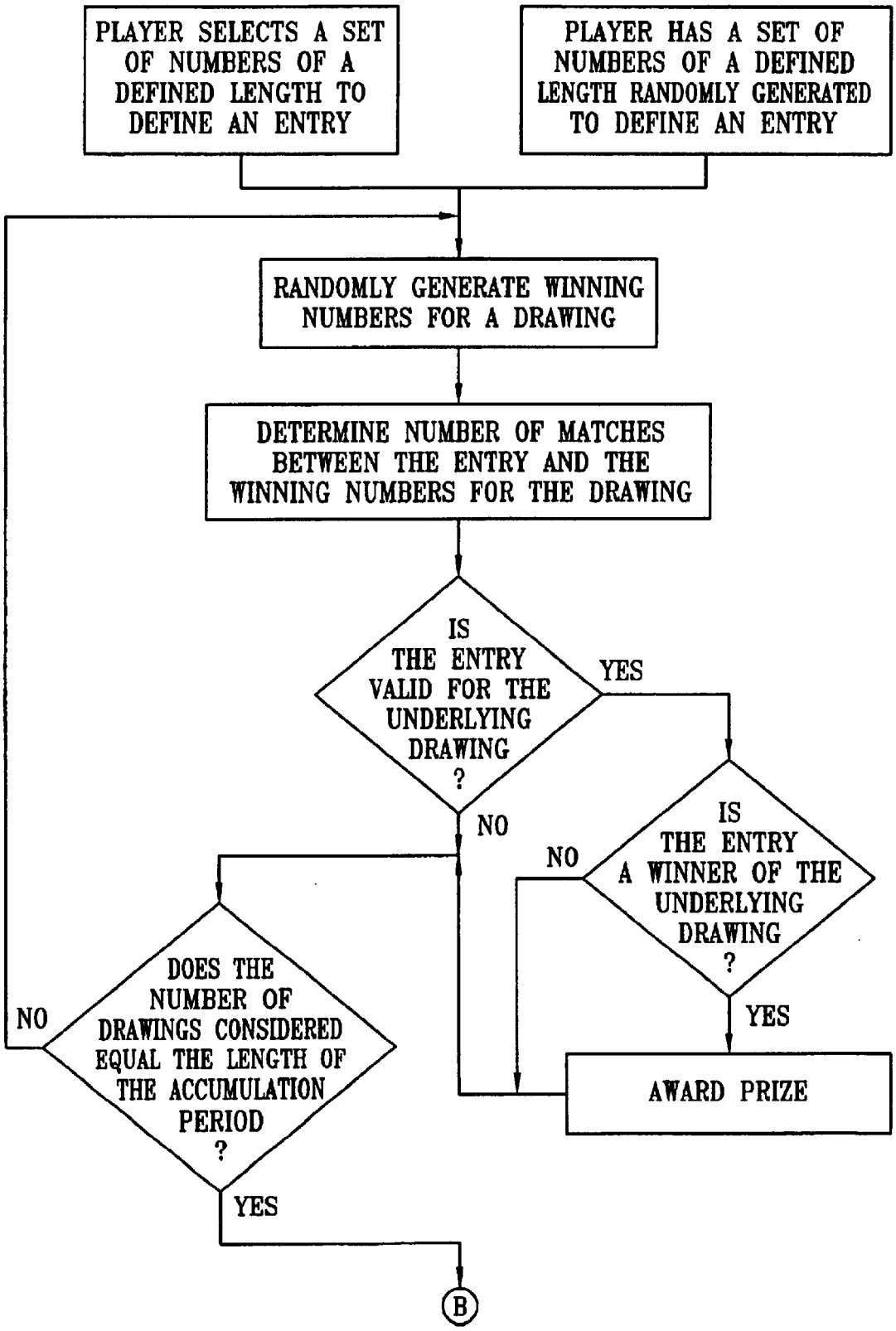
FIGS. 2*a* and 2*b* is a flow chart depicting a second embodiment of the current invention where the invention is applied in the context of a lotto game.
Figure 2B:
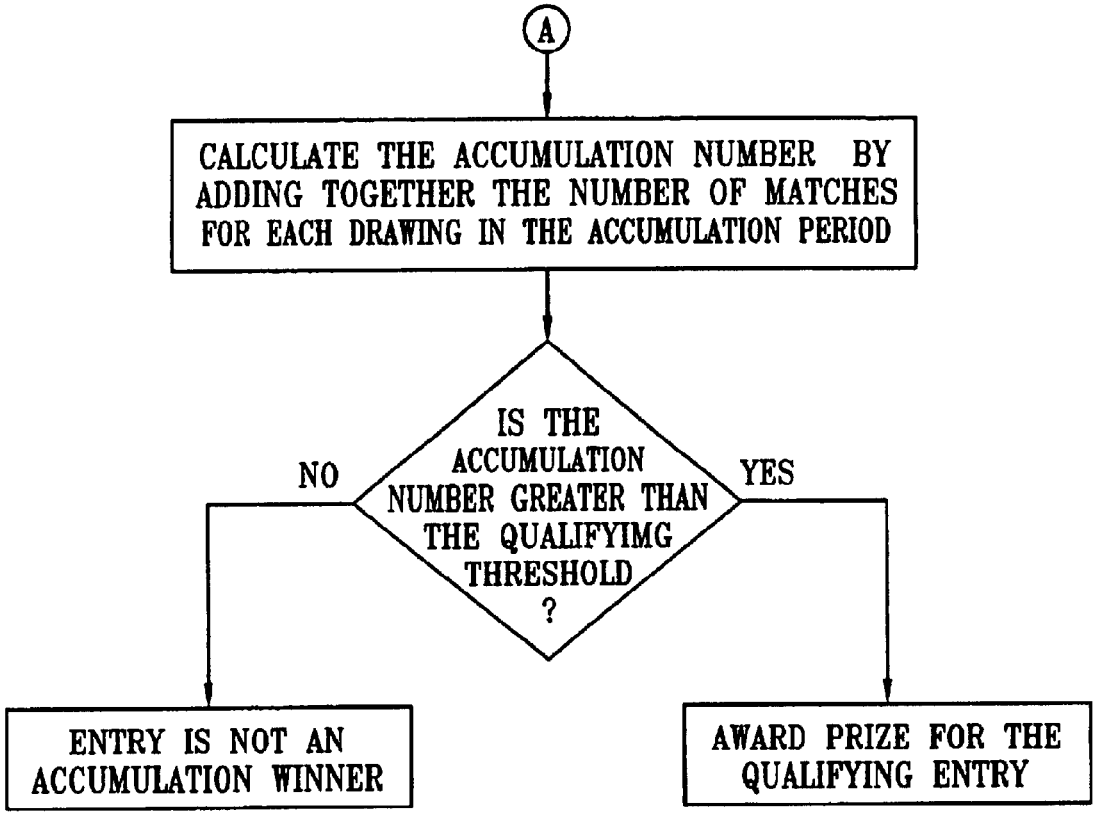

A second embodiment, shown in FIGS. 2*a* and 2*b*, is directed to applying the invention to a standard lottery game and is referred to as "Accumulation Lotto." Players would purchase the lottery tickets in the same manner currently used by state lotteries. For an additional payment, players can add the Accumulation option to their tickets. The numbers selected remain live through a number of consecutive drawings and accumulate a total number of matches. The accumulation period of various tickets will start and end on different drawings. Entries that amass an accumulation total above a threshold amount would be winners and qualify for the later rounds of prizes.

As shown in FIG. 3, monthly prizes are awarded for the qualifying entries, purchased that month, that have the highest accumulated matches compared to the maximum possible matches for the their respective accumulation periods. In addition, Grand Prizes are awarded for those entries that amassed the highest accumulation totals, during their respective accumulation periods, over the course of the entire game, which is preferably a calendar year, though some lottery operators may opt to offer games of shorter duration. Alternatively, the Grand Prizes can be awarded to the player that has the highest accumulation total calculated by adding up all of the qualifying tickets purchased by that player. Unlike traditional tickets where a certain number of correct matches are required to win, it is guaranteed that the major accumulation prizes will be distributed at predetermined intervals for the ticket that has achieved the highest number of accumulated matches.

The lottery agency will determine the duration of the accumulation period as well as the payoff thresholds and payoff amounts. These determinations can be easily made by one of skill in the art based upon the particular circumstances. For example, assuming the local lotto rules permit distribution of 65% of the total wager, an average of four million $1 entries are sold per draw, there are two drawings a week, and a full calendar year game period, there would be a total wager base of $416,000,000 per year. Further assuming that 70% of the tickets are purchased using the maximum number of chances per entry slip, which is typically five, and that the accumulation mode is based upon an additional $1 for each of those entry slips, and that only purchasers of five game entries can add the accumulation option, then the total wager in the separate accumulation pool would be approximately $58 million during the year, of which around $38 million would be available for payments to winners under the local lottery rules.

Under these circumstances, the preferred payout schedule would look something like the following. The accumulation period would be ten draws and would begin with the regular drawing. The accumulation period could also start with the drawing following that for which the regular ticket was purchased if it is considered that winners in the traditional drawing should not be given any "kick-off" advantage in the event they repeat the same numbers in each of the panels.

In a standard six number lottery, depending on whether any numbers are duplicated on the entry slip, there are a maximum of thirty "hit" possibilities for a five-line ticket, for each drawing, resulting in a total of 300 hit chances during the ten game accumulation life of the ticket. The qualification level may be 150 hits during the accumulation period and total payout at this level would be set at about 15% of the total funds available to all winners over the full twelve-month cycle, which is about $5,700,000 in this case. The payout would vary depending upon the probability of reaching the 150 hit threshold, which can be easily calculated based upon the size of the pool of numbers that can be selected. The payout to qualifiers could range from $25 to $250 depending upon the odds of surpassing the threshold number of hits. In addition, the threshold number itself could be adjusted based upon the probabilities in order to provide a desired payout amount and still ensure that sufficient funds remain for the other Qualifiers. Based upon the above example, in a lottery pool of fifty (50) numbers, the payout could be in the $25 to $250 range when the threshold for matches to qualify is set by the lottery operator between sixty-five (65) and eighty-five (85), depending upon the percentage of total payout that the lottery operator reserves for payment at the First Tier Prize level and the likelihood that a player may select the same number several times on a five-line entry slip.

All of the Qualifiers remain in the pool for the guaranteed Second Tier prizes that are distributed monthly. The tickets with the highest number of matches during their respective accumulation periods, which ended in that month would be awarded the monthly prizes. The monthly prize can be awarded entirely to the ticket with the highest number of matches or more preferably, a range of prizes are awarded to the group of tickets that have the highest number of matches. An example of suggested preset prizes would be $250,000 for the monthly winner, $50,000 for second place, $25,000 each for third through fifth places and $5,000 each for the following 25 next highest tickets.

The Third Tier Grand Prizes are awarded at the end of the game, in this case at the end of the year, to the players with the most accumulated hits or matches on a single ticket or, at the option of the lottery operator, who have accumulated the most hits taken from all of the Qualifying accumulation tickets that the player has purchased. The advantage to the later option for the lottery operator is that it would more likely trigger a more consistent flow of repeat entries with every five play entry slip purchased for the regular draws.

The prizes can be awarded on a progressive basis, based upon the total amount that ends up in the separate pool, or they may be preset amounts that are decided at the start of the annual game. An example of preset prizes for the Third Tier, Grand Prize, level is: $25,000,000 grand prize, $500,000 second place, and $250,000 for third through fifth places.

Under the suggested prize schedule, 15% of the available prize fund or about $5,700,000 is distributed to Qualifiers during the entire year. An additional $6,000,000 is distributed as monthly awards during the course of the year, leaving over $26 million for the end of the year awards. The suggested end-of-game Third Tier Grand Prizes add up to $26,250,000, which leaves approximately $50,000 left from the original $38,000,000 available as payouts to all of the winners. This would serve as a small buffer in case more then the average number of tickets qualifies in any particular year.

The proposed accumulation variant would not likely require any additional hardware or require a significant change in the way the lottery game is run. It is likely that the existing system software used by the Lottery Commission, could be adapted to keep track of the accumulating hits of the tickets. Alternatively, a simple storage and retrieval system can be overlaid on the standard system to keep track of and maintain that the necessary information. Storage capacity requirements would be limited to keeping track of only the relatively small number of tickets that remain in contention for the larger prizes beyond each prize level.

Similar to the Keno embodiment, the procedure would only require the addition of a cipher to the ticket to identify it as an accumulation ticket as well as the last drawing of the accumulation period. The lottery ticket already identifies the initial drawing and often has a unique identification code to make it easier for untrained staff to verify if the ticket is a winner. The ticket's identification number can also be linked to inform the ticket staff whether the ticket is a Qualifying ticket after its accumulation period has ended. The only significant change is that the ticket must be marked or a new ticket issued for tickets that are winners during the original drawing.

Several advantages of such an accumulation variation are apparent for the lottery operator. First, the average wager per ticket would be increased, thereby increasing revenue without the need to issue additional tickets. Second, it would provide a separate revenue stream in addition to and that does not replace the original revenue stream from the traditional lottery game. Third, the addition of the accumulation offering has the potential to increase sales especially during periods when the traditional jackpot is low.

The number of lottery tickets sold is in direct proportion to the potential size of the regular single-draw jackpot. During periods when there is no carry-over jackpot from the previous drawing or when the carry over is not very large, there are significantly fewer tickets sold. It is extremely beneficial to the lottery operator to increase sales during these periods. The accumulation variation to the traditional lottery has the potential to achieve increases in sales during times of lower traditional jackpots. This is because the accumulation option gives players a chance to win the guaranteed accumulation prizes that are completely independent of the size of the traditional jackpot and are set at levels to encourage participation no matter how small the regular jackpot. Additionally, the chance of winning the monthly prizes is somewhat higher during months where fewer tickets are sold.

This accumulation variation is also an attractive option for the players as well. It does not alter in any way their ability to play the traditional lottery. It is also convenient, for a modest additional fee, to be able to extend the life of their numbers for an additional number of drawings. This provides players with additional method of winning based upon the single ticket purchased. It also can add to the excitement of the drawings without the player having to purchase tickets for each drawing. Finally, these benefits are available for all purchased tickets and does not depend on the time or date that the accumulation ticket was purchased.

The above description of certain embodiments are made for the purpose of illustration only and are not intended to be limiting in any manner. Other alterations and modifications of the preferred embodiment will become apparent to those of ordinary skill in the art upon reading this disclosure, and it is intended that the scope of the invention disclosed herein be limited only by the broadest interpretation of the appended claims to which the inventor is legally entitled.

What is claimed is:

1. A method of conducting a lottery-style game of chance comprising the steps of:

having a player select a first set of numbers constituting an entry;

randomly generating a plurality of second sets of numbers;

calculating an accumulation number for said entry by comparing it with a defined number of said plurality of second sets of numbers;

awarding said player a prize if said accumulation number for said entry is higher than a qualifying threshold.

2. The method of claim 1 wherein said player selects said first set of numbers by requesting said first set be randomly generated.

3. The method of claim 1 wherein a plurality of players each select a first set of numbers constituting an entry.

4. The method of claim 3 further comprising: awarding a second prize after a first defined interval to at least one of said plurality of players whose entry has the highest accumulation number during said first defined interval.

5. The method of claim 4 wherein additional said second prizes are awarded for subsequent said first defined intervals.

6. The method of claim 5 further comprising: awarding a third prize after a second defined interval to at least one of said plurality of players whose entry has the highest accumulation number during said second defined interval.

7. The method of claim 6 wherein said first defined interval is a month and said second defined interval is a year.

8. The method of claim 6 wherein only players winning said first prize are eligible to win said second prize or said third prize.

9. The method of claim 1 wherein said first set of numbers has a length selected from an allowed range.

10. The method of claim 9 wherein said accumulation number is a ratio between said total number of matches between said first set of numbers and said defined number of said plurality of second sets of numbers and said length of said first set of numbers.

11. The method of claim 9 wherein said first set of numbers is provided by a set of numbers selected by said player for a Keno game.

12. The method of claim 1 wherein said first set of numbers is of a predefined length.

13. The method of claim 12 wherein each of said plurality of second sets of numbers is of the same length as said first set of numbers.

14. The method of claim 12 wherein said accumulation number is determined by adding together the number of matches between said first set of numbers and said defined number of said plurality of second sets of numbers.

15. A method of conducting a lottery-style game of chance comprising the steps of:

having players each select a first set of numbers of a fixed length constituting an entry;

randomly generating a plurality of second sets of numbers of said fixed length;

calculating an accumulation number for each said entry by adding up the number of matches between said first set of numbers and a defined number of said plurality of second sets of numbers;

awarding a prize if said accumulation number for said entry is higher than a qualifying threshold;

awarding a second prize after a first defined interval to at least one of said players whose entry has the highest accumulation number during said first defined interval;

awarding a third prize after a second defined interval to at least one of said players whose entry has the highest accumulation number during said second defined interval.

16. The method of claim 4 wherein additional said second prizes are awarded for subsequent said first defined intervals.

17. The method of claim 16 wherein said first defined interval is a month and said second defined interval is a year.

18. The method of claim 16 wherein only players winning said first prize are eligible to win said second prize or said third prize.

19. A method of conducting a lottery-style game of chance comprising the steps of:

having players each select a first set of numbers constituting an entry that is of a length selected from an allowed range;

randomly generating a plurality of second sets of numbers of a predefined length;

calculating an accumulation number for each entry that is a ratio between the total number of matches between said first set of numbers and a defined number of said plurality of second sets of numbers and said length of said first set of numbers;

awarding a prize if said accumulation number for said entry is higher than a qualifying threshold;

awarding a second prize after a first defined interval to at least one of said players whose entry has the highest accumulation number during said first defined interval;

awarding a third prize after a second defined interval to at least one of said players whose entry has the highest accumulation number during said second defined interval.

20. The method of claim 19 wherein additional said second prizes are awarded for subsequent said first defined intervals.

21. The method of claim 20 wherein said first defined interval is a month and said second defined interval is a year.

22. The method of claim 20 wherein only players winning said first prize are eligible to win said second prize or said third prize.

* * * * *